US007641411B2

(12) United States Patent
Biegel

(10) Patent No.: US 7,641,411 B2
(45) Date of Patent: Jan. 5, 2010

(54) APPLICATOR DEVICE

(75) Inventor: Friedrich Biegel, Nuremberg (DE)

(73) Assignee: Schwan-STABILO Cosmetics GmbH & Co. KG, Heroldsberg (DE)

( * ) Notice: Subject to any disclaimer, the term of this patent is extended or adjusted under 35 U.S.C. 154(b) by 399 days.

(21) Appl. No.: 11/179,403

(22) Filed: Jul. 12, 2005

(65) Prior Publication Data

US 2006/0222446 A1 Oct. 5, 2006

(30) Foreign Application Priority Data

Mar. 30, 2005 (DE) ..... 10 2005 014 409

(51) Int. Cl.
*B43K 23/08* (2006.01)

(52) U.S. Cl. ..... 401/213; 401/103; 401/171; 401/172; 401/174

(58) Field of Classification Search ..... 401/216, 401/213, 245–247, 171–174, 176, 180, 66, 401/61, 182, 205, 206, 148, 103, 214
See application file for complete search history.

(56) References Cited

U.S. PATENT DOCUMENTS 2,258,841 A * 10/1941 Biro ..... 401/180
2,432,061 A * 12/1947 Chesler ..... 401/162
2,536,924 A * 1/1951 Fehling ..... 401/213
5,242,234 A * 9/1993 Ahrens ..... 401/180
5,423,623 A * 6/1995 Bakic ..... 401/68
5,482,393 A * 1/1996 Sekiguchi et al. ..... 401/214
6,340,261 B1 1/2002 Furukawa
6,361,234 B1 * 3/2002 Rukan et al. ..... 401/180
6,729,787 B2 * 5/2004 Usami et al. ..... 401/171
6,758,619 B1 * 7/2004 Yeh ..... 401/180
6,880,999 B2 * 4/2005 Biegel et al. ..... 401/180
7,140,798 B2 * 11/2006 Nakamura et al. ..... 401/213
7,144,175 B2 * 12/2006 Biegel ..... 401/213

FOREIGN PATENT DOCUMENTS

| | | |
|---|---|---|
| DE | 1 248 509 | 8/1967 |
| DE | 77 13 285 | 9/1977 |
| DE | 8519712 | 11/1986 |
| DE | 203 01 714 | 6/2003 |
| EP | 1 445 121 | 8/2004 |
| EP | 1445121 | 8/2004 |
| GB | 597143 | 1/1948 |

* cited by examiner

*Primary Examiner*—David J Walczak
(74) *Attorney, Agent, or Firm*—Bachman & LaPointe, P.C.

(57) ABSTRACT

An applicator device comprising a casing and an application element wherein the application element is displaceable with respect to the casing against a return force.

17 Claims, 9 Drawing Sheets

A-A

A-A

A

A-A

B

A

A-A

B

A

A-A

B

APPLICATOR DEVICE

BACKGROUND OF THE INVENTION

The invention concerns an applicator device comprising a casing and an application means.

Applicator devices of that kind are known. They involve for example ballpoint pens. If such an applicator device is used on a substrate which is easily displaceable in the application plane, then conventional applicator devices are not suitable for application thereon because folds are thrown up, that is to say raised portions, which stand up out of the plane of the substrate. The difficulty of producing on such a substrate a uniform application such as for example a line of a constant line width are similarly high as in the case of a substrate which is structured from the outset—in such a way as to be perceptible to the eye.

The object of the present invention is to improve the applicator device of the kind set forth in the opening part of this specification, such that it is suitable for substrates which are displaceable in the application plane as well as for structured substrates.

SUMMARY OF THE INVENTION

The foregoing object is attained in accordance with the present invention wherein the application means is displaceable with respect to the casing against a return force. The invention relates in particular to an applicator device for a cosmetic product.

When the applicator device according to the invention is applied to an easily displaceable substrate such as for example to the skin or a textile-like surface, the application means can elastically recoil in the axial direction without requiring the collaborative involvement of that person who is guiding the applicator device. Particularly when used on the skin, that has the advantage that the male or female user still has to concentrate only on positioning in the plane of the skin. In addition, the risk of injury is minimised in the case of uses in the proximity of the eye.

If the attempt is made to produce a line of constant line thickness on a structured substrate such as for example a textile article or on crepe paper, then the applicator device according to the invention can be guided at a constant spacing which is less than the set spring travel. By virtue of the elastically resilient properties, the applicator device provides for self-regulating compensation in respect of the application plane-casing spacing and thus ensures a line of constant width. In addition the resilient arrangement reduces or entirely eliminates the risk of folds or wrinkles being formed because the force in the application direction is minimised by virtue of the applicator means yielding.

In a situation involving the application of products to the skin, that virtually self-regulating mechanism affords the advantage that the pressure of the application means on the skin is approximately constant at any time and is independent of the spacing of the casing relative to the surface of the skin, at any event within the regulating range for the spring effect. The user is also freed of precisely maintaining the casing-skin spacing and can be certain of uniformly achieving the desired line thickness.

That virtually self-regulating mechanism can be adjusted by suitable adjustment of the maximum free travel length and the effective spring constant, within relatively wide ranges. In that way it is easily possible to provide for adaptation to the properties of a structured and/or easily displaceable substrate, in regard to the length of the spring travel.

In a preferred feature of the invention the application means is displaceable with respect to the casing by between 0.05 mm and 10 mm, preferably between 0.05 mm and 2 mm, further preferably between 0.2 mm and 0.5 mm.

In a further preferred feature of the invention the return force is between 0.03 N and 50 N, preferably between 0.03 N and 10 N, further preferably between 0.03 N and 0.5 N.

In accordance with a further preferred feature of the invention it is provided that the application means has a ball and the quotient of the return force and the equatorial cross-sectional area of the ball is between 4 Pa and 6 GPa, preferably between 40 Pa and 1 GPa, further preferably between 10 kPa and 7 MPa.

In accordance with an embodiment of the invention which is preferred as being particularly simple there is provided at least one elastic element for producing the return force.

In a further preferred feature the elastic element is a spring.

An embodiment which is particularly simple and therefore further preferred in accordance with the invention is one in which the elastic element is a coil spring.

It is preferred in accordance with the invention for the elastic element to comprise a polymer material. That provides that the elastic element is particularly simple and inexpensive to produce. In addition it is light.

In accordance with a particularly preferred embodiment of the invention the applicator device has a storage means for a product to be applied, wherein it is further provided that the elastic device belongs to an increased pressure-producing device and is adapted to press with its elastic return force against a boundary means of the storage means to produce an increased pressure in the storage means.

In other words, there is provided an elastic device which serves two kinds of purposes, namely on the one hand elastic biasing of the application means against axial displacement with respect to the casing and on the other hand production of an increased pressure in the storage means. That reduces the total number of individual parts, which overall simplifies the application means.

In accordance with a further preferred feature of the invention it is provided that the increased pressure-producing device is controllable in the sense of a reduction in the pressure in the storage means.

Such a fall in pressure can involve a relief in load on the elastic device, thereby in turn affording the possibility of using a polymer material for the elastic device, with the advantages already set forth hereinbefore.

In accordance with a further preferred embodiment of the invention it is provided that the increased pressure-producing means has a transmission means with at least one female screwthread element and at least one male screwthread element, wherein the transmission means can assume at least two operating conditions, namely a first operating condition in which the two screwthread elements mesh with each other to produce the increased pressure, and a second operating condition in which they do not mesh with each other, thereby resulting in a reduction in the increased pressure.

In other words, in accordance with this preferred embodiment of the invention, it is provided that two screwthread elements are coupled together to produce the increased pressure and are uncoupled to reduce the pressure in the storage means. This therefore affords a solution which is particularly simple from the point of view of structure, inexpensive and easy to handle.

It can happen that a user of the applicator device forgets to reduce the pressure in the storage means after work has been done. In such a case, under some circumstances, the product which is to be applied can suffer from damage in the storage means. In addition it is not possible to be sure that the product will not escape.

In accordance with a particularly preferred embodiment of the invention it is therefore provided that the applicator device can assume at least two operating conditions, namely a rest condition and a use condition, and has a means for reducing the pressure in the storage means, said pressure-reducing means being responsive to a movement of the applicator device from the use condition into the rest condition. In other words, this configuration of the invention provides that the pressure in the storage means is reduced automatically as soon as the applicator device—after its work has been done—is put into the rest condition.

In that respect it can be provided that the applicator device is changed from the use condition into the rest condition by screwing on a cap. Instead of screwing on the cap, the cap can also be fitted on and fixed by means of a bayonet connection.

That therefore embodies a substantially 'automatic' mechanism.

BRIEF DESCRIPTION OF THE DRAWINGS

The invention is described in greater detail hereinafter by means of a preferred embodiment by way of example with reference to the accompanying drawing in which.

DETAILED DESCRIPTION

Figure 1:
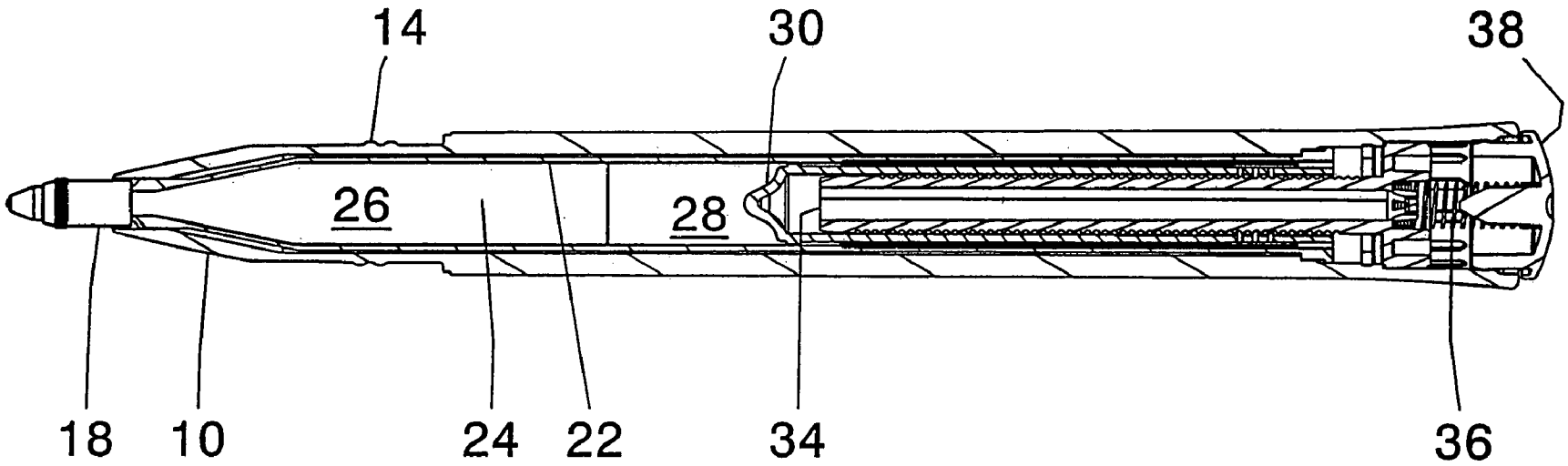
FIG. 1 is a diagrammatic view in longitudinal section of a pencil according to a particularly preferred embodiment of the invention.

Referring to the figures, the pencil has an outer shaft 10 which serves as a casing and on to which a cap 12 can be screwed. For that purpose there is provided a screwthread identified by reference numeral 14. The cap 12 has a seal 16 which sealingly embraces a tip 18 of the pencil in the screwed-on condition. A ball 20 is held at the free end of the tip 18. A row of teeth 19 on the cap 12 and a ring of teeth 21 on the pencil serve for rotationally coupling the cap 12 to the tip 18 when it is screwed on.

At its end portion remote from the ball 20 the tip 18 is fitted on to a lead or cartridge casing portion 22. In that region the tip 18 is of a circular internal contour and the casing portion 22 is also of a circular external contour, thus affording a slipping clutch.

The internal space of the casing portion 22 forms a storage means 24 for ink 26. Arranged on the side remote from the ball 20 in the storage means 24 is a closure mass which serves for sealing off in relation to the ambient atmosphere. The rear boundary of the storage means 24 is formed by a plunger 30. A control pushrod 34 projects into the plunger 30. A spring 36 bears on the one hand against the control pushrod 34 and on the other hand against a closure cap 38. The spring 36 is a polymer spring. It can also be of metal or other suitable material.

Figure 2:
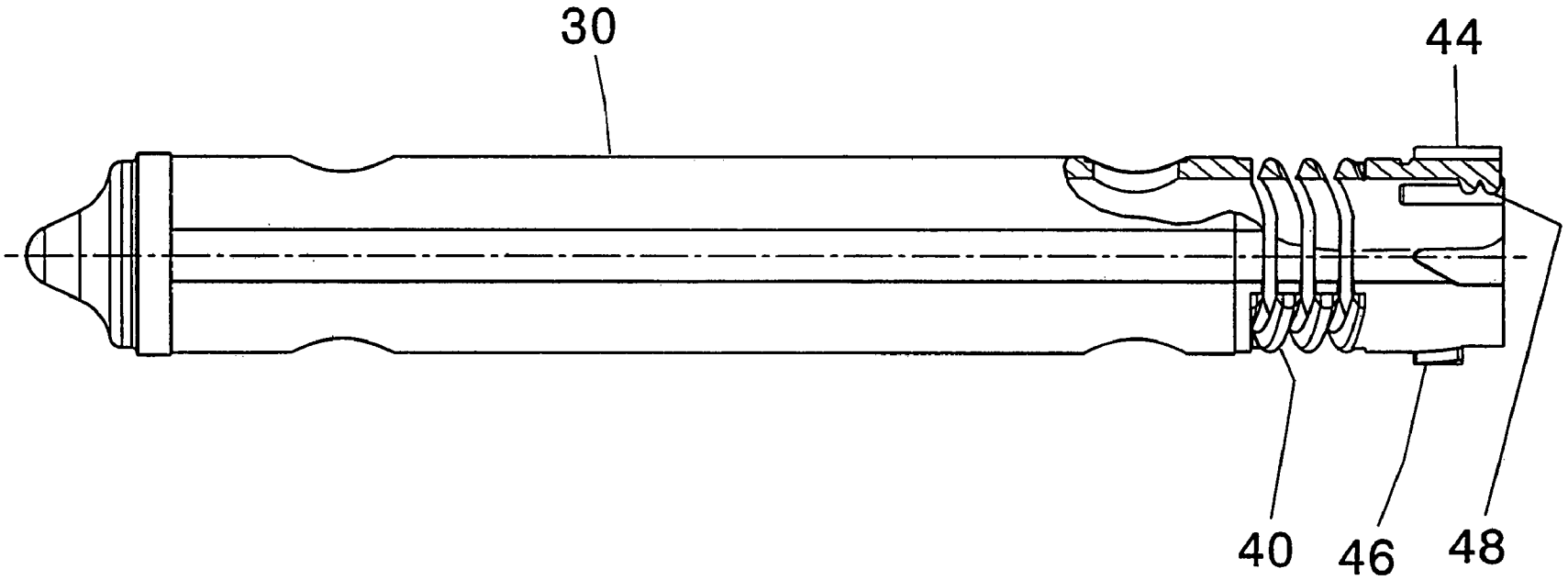
FIG. 2 shows a partly sectional view of a plunger of the pencil of FIG. 1.

As can be seen from FIG. 2 provided on the plunger 30 is a helical incision 40 whereby the plunger is variable in respect of its length. As a result it represents a trailing plunger.

At its end portion remote from the tip 18 the plunger 30 has projections 44 and 46 which for rotational coupling purposes engage into corresponding recesses in the casing portion 22. Accordingly the plunger 30 is admittedly rotationally coupled to the casing portion 22 but it is held axially slidably therein.

Also at its end portion remote from the tip 18 the plunger 30 is provided in its interior with two substantially hemispherical female screwthread elements of which one is denoted by reference 48 and which serve for coupling—at times—to the control pushrod 34.

Figure 3B:
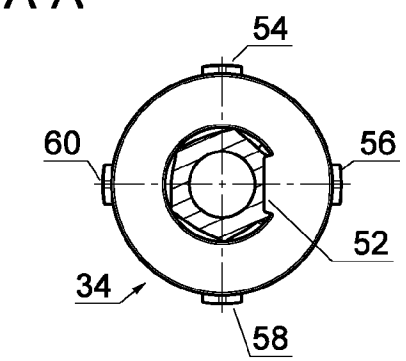
FIG. 3*b* is a partial sectional view taken along line A-A of FIG. 3*a*.
Figure 3A:
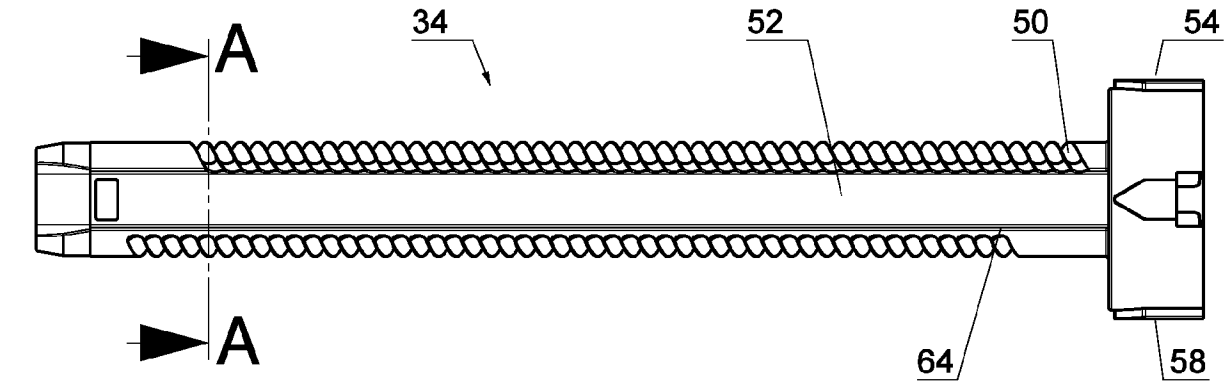
FIG. 3*a* shows the control pushrod of the pencil of FIG. 1
Figure 4:
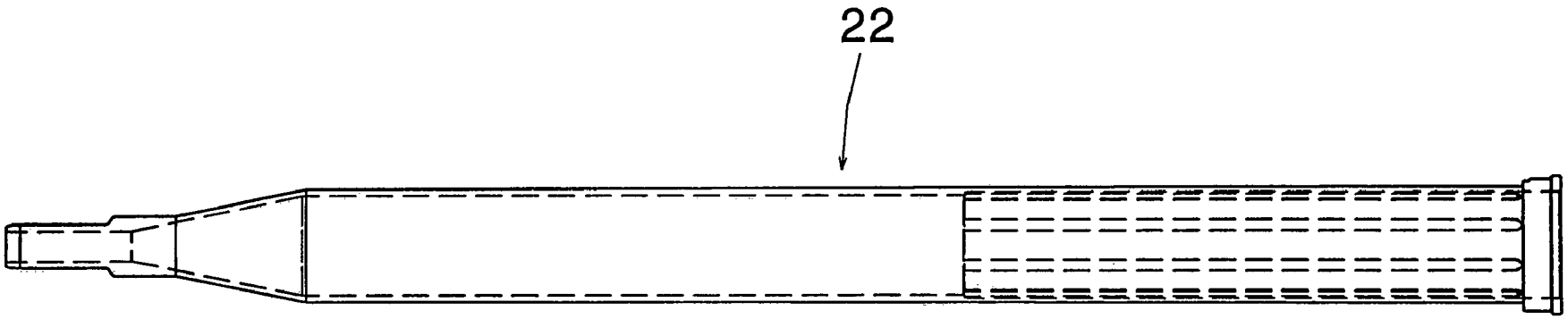
FIG. 4 shows a diagrammatic view of a lead or cartridge casing portion of the pencil of FIG. 1.
Figure 5A:
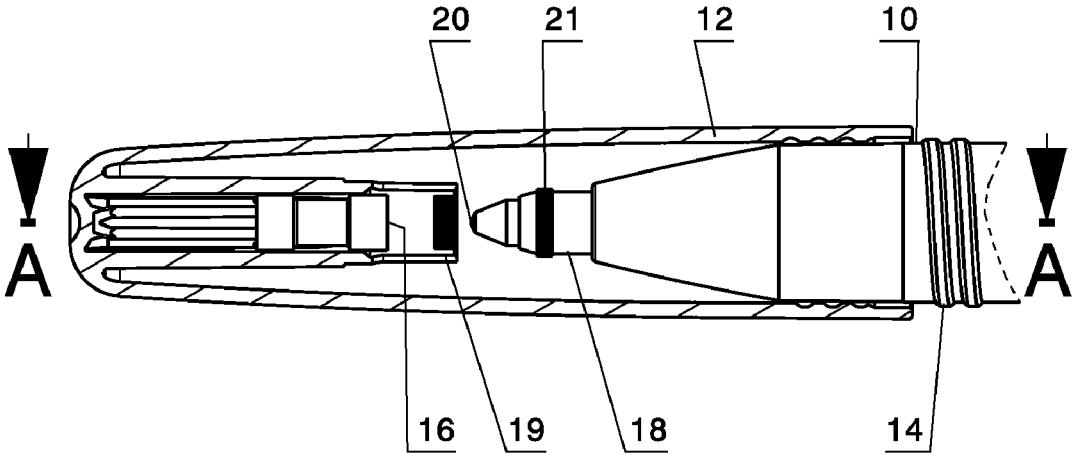
FIG. 5*a* shows a front part of the pencil of FIG. 1
Figure 5B:
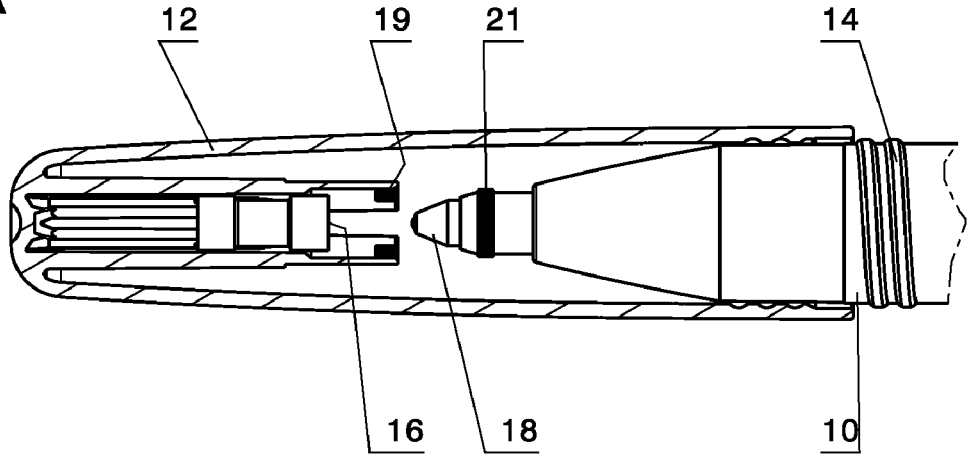
FIG. 5*b* is a sectional view taken along line A-A of FIG. 5*a*.
Figure 6A:
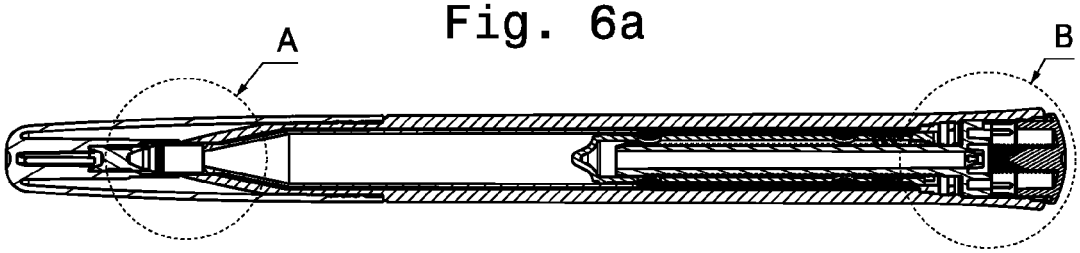
FIG. 6*a* shows the pencil of the present invention in a non-operating condition.
Figure 6B:
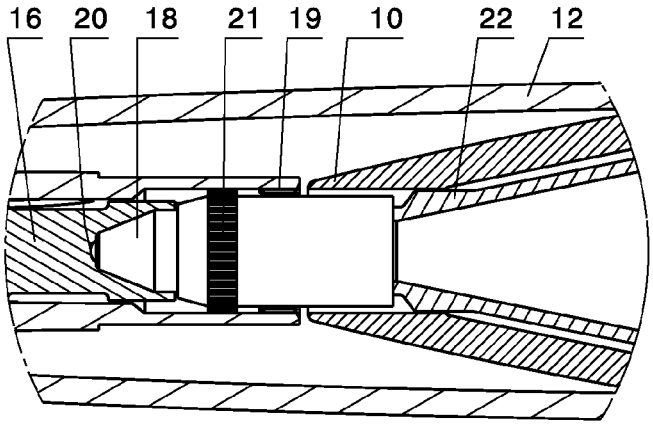
FIG. 6*b* is an enlarged view of area A of FIG. 6*a*.
Figure 6C:
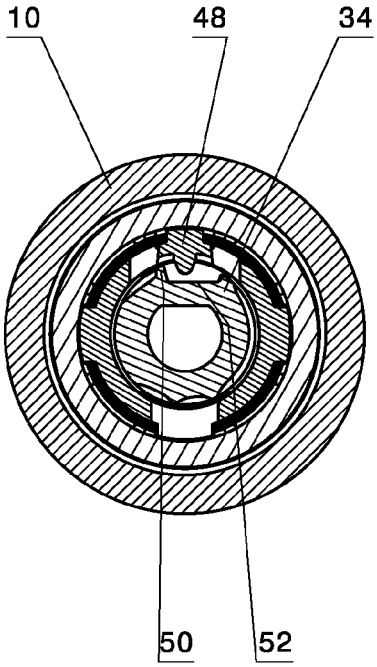
FIG. 6*c* is a sectional view taken along line A-A of FIG. 6*d*.
Figure 6D:
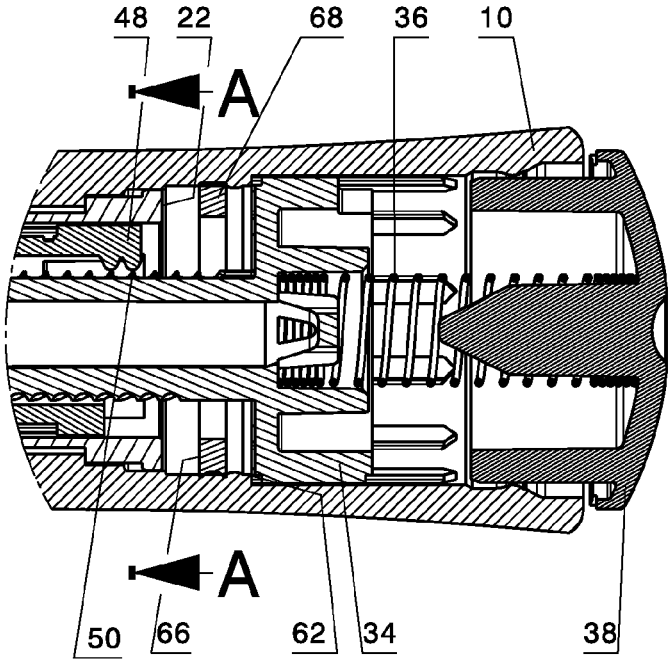
FIG. 6*d* is an enlarged view of area B of FIG. 6*a*.

The control pushrod 34, as shown in FIGS. 3*a* and 3*b*, is provided with male screwthread elements which are complementary to the female screwthread elements 48 and of which one is identified by way of example by reference 50. The male screwthread elements 50 correspond to segments of a helical groove and respectively extend over an angle of somewhat more than 300°. They are interrupted by a longitudinal groove 52 which extends over an angle of about 27°.

At its end portion remote from the tip 18 the control pushrod 34 is provided with projections 54, 56, 58 and 60 which engage into corresponding recesses in the external shaft 10 for rotational coupling purposes. The control pushrod 34 is however slidable axially with respect to the external shaft 10 between the closure cap 38 and an abutment 62.

The function of the pencil illustrated in the drawing is as follows:

With reference to FIGS. 6*a* through 6*d*, when the cap 12 is screwed on to the external shaft 10, the female screwthread elements 48 are in the groove 52. Accordingly, in that operating position, there is no coupling between the control pushrod 34 and the plunger 30. The plunger 30 therefore does not apply any pressure to the closure mass 28 or the ink 26. That is important in regard to inks and/or closure masses which are adversely affected by a permanent pressure. The spring 36 is relieved of stress when the cap 12 is screwed on to the external shaft 10. It is therefore possible to use a polymer spring. More specifically, when using a polymer spring, permanent stressing would lead to material fatigue.

With reference to FIGS. 7*a* through 7*d*, when the cap 12 is rotated with respect to the external shaft in order to unscrew it, then, because of the rotational coupling between the row of teeth 19 and the ring of teeth 21, the tip 18 also rotates. The plunger 30 therefore also rotates. In the further course of the rotary movement, shown in FIG. 7*c*, the female screwthread elements 48 leave the groove 52 and pass into the male screwthread element 50. Further rotary movement in that condition provides that the female screwthread elements 48 travel along the male screwthread element 50, whereby the control pushrod 34 which hitherto has been supported against the projection 62 is displaced against the spring 36. It is only now that the spring 36 is stressed. As a result the elastic return force of the spring 36 acts by way of the control pushrod 34 on the plunger 30, whereby the pressure in the storage means 24 rises. At its end, the male screwthread element 50 is limited by an abutment 64 against which the female screwthread elements 48 butt upon further rotary movement. If nonetheless the rotary movement is continued, then the slipping clutch formed between the casing portion 22 and the tip 18 slips so that the pressure in the storage means 24 does not rise further. That is therefore kind to a possibly pressure-sensitive ink.

The increased pressure which is now built up in the storage means 24 can be used for discharging the ink 26.

When, after use of the pencil, the cap 12 is screwed on to the external shaft 10 again, the female screwthread elements 48 travel back along the male screwthread element 50 into the groove 52 again, because of the coupling effects described in detail hereinbefore. As a result, under the influence of the spring 36, the control pushrod 34 travels again towards the abutment 62 where it is supported. Accordingly the spring 36 no longer acts on the ink 26 by way of the plunger 30. In that condition there is no longer any increased pressure prevailing in the storage means 24, which is advantageous in terms of protecting the ink 26 and in regard to the aspect of anti-leakage safeguard. In addition the spring 36 is also protected.

When the cap 12 is screwed on to the external shaft 10 the plunger 30 is moved away from the ball 20 until the female screwthread elements 48 pass into the groove 52. So that in that situation the plunger 30 does not suck the ink 26 out of the tip 18, the plunger 30 is provided with the helical incision 40 and as a result is in the form of a trailing plunger. More specifically it can increase in length in that situation.

Instead of the screwthread 14, it is also possible to provide a bayonet connection for holding the cap 12 on the external shaft 10. In that case, under some circumstances, it is possible to forego limiting the increased pressure by means of the abutment, because, when a bayonet connection is involved, that angle through which the two parts which are to be connected together can be rotated relative to each other is in any case limited.

For pressure limitation purposes, it can further be provided that the row of teeth 19 comes into engagement with the ring of teeth 21 only over a part of the axial travel of the cap 12 when it is screwed on to the external shaft 10.

The rotary transmission means shown in the drawing can compensate for a reduction in the filling level in the storage means 24. More specifically, with a decreasing filling level, the plunger 30 gradually moves into the storage means 24, whereas the control pushrod 34 does not change its position relative to the spring 36 in accordance with the filling level, and for that reason the same return force is always available for producing the increased pressure.

Springing of the tip 18 in the axial direction with respect to the external shaft 10 is described hereinafter.

Figure 7A:
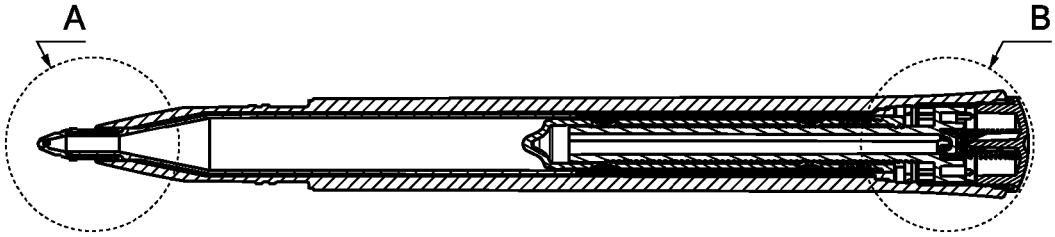
FIG. 7A shows the pencil of the present invention in an operating condition ready to write.
Figure 7B:
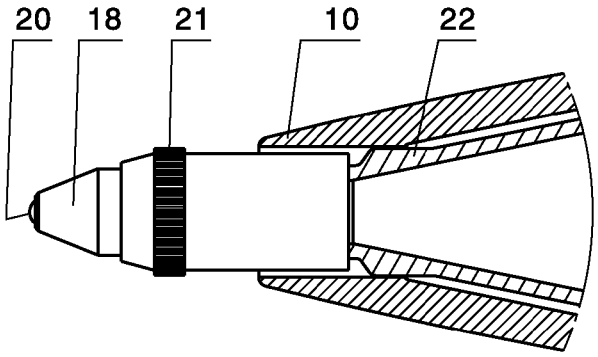
FIG. 7*b* is an enlarged view of area A of FIG. 7*a*.
Figure 7C:
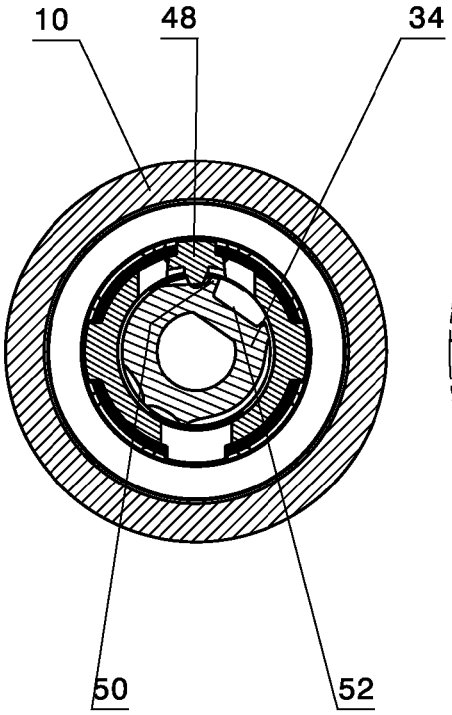
FIG. 7*c* is a sectional view taken along line A-A of FIG. 7*d*.
Figure 7D:
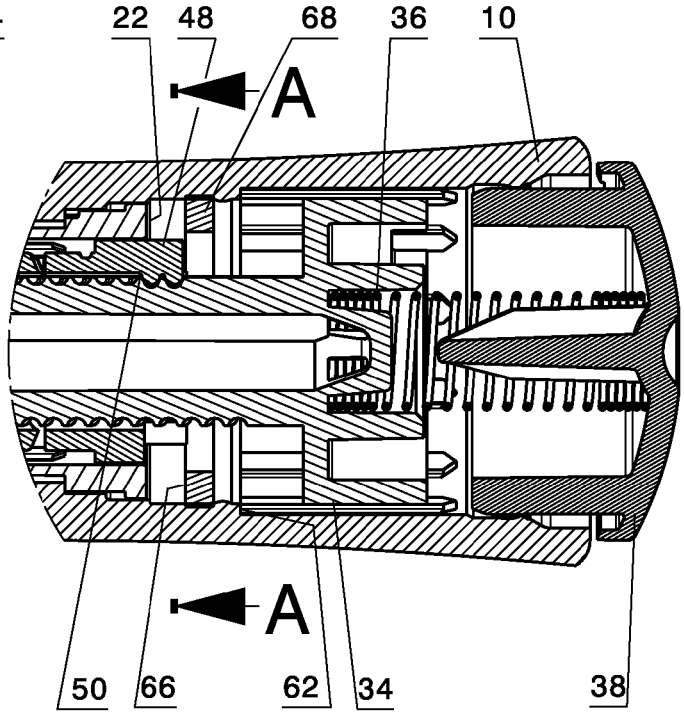
FIG. 7*d* is an enlarged view of area B of FIG. 7*a*.
Figure 8A:
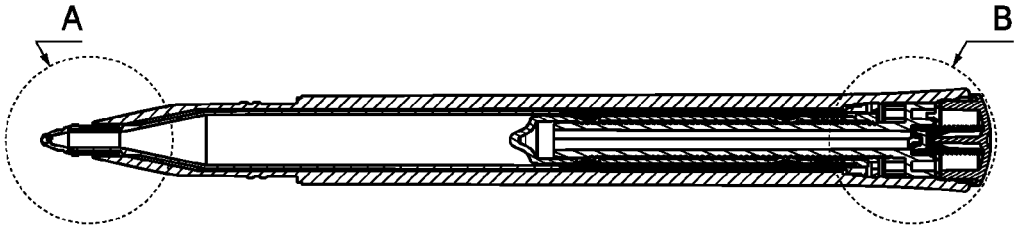
FIG. 8*a* shows the pencil in a slightly different operating position than FIG. 7*a* as described in paragraph.
Figure 8B:
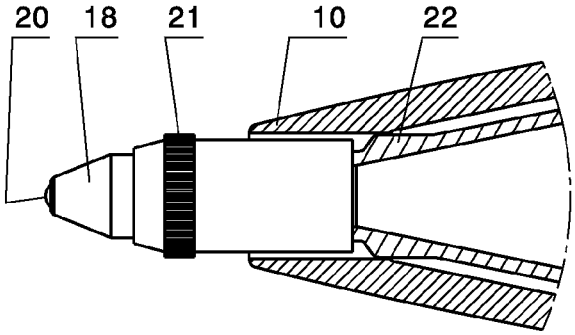
FIG. 8*b* is an enlarged view of area A of FIG. 8.
Figure 8C:
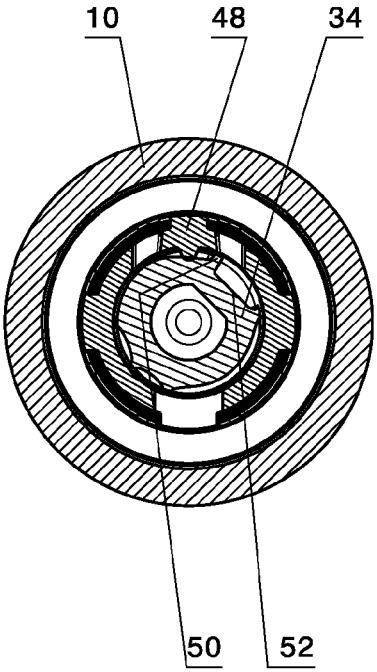
FIG. 8*c* is a sectional view taken along line A-A of FIG. 8*d*.
Figure 8D:
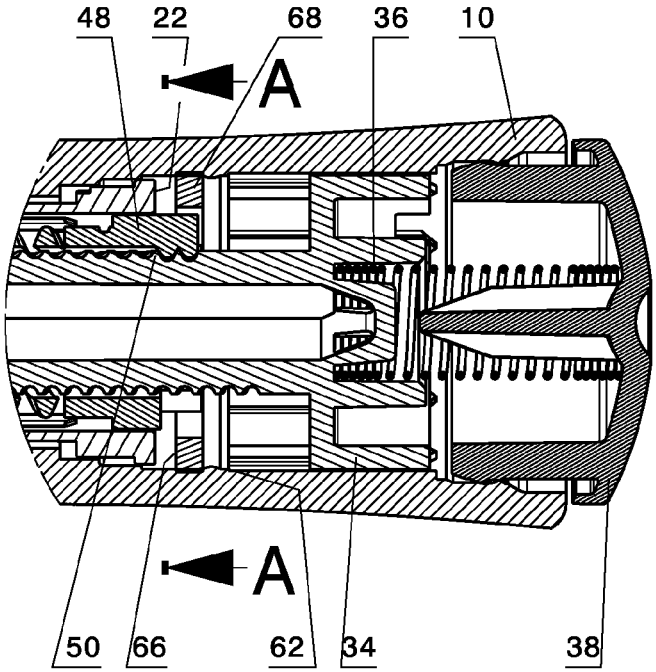
FIG. 8*d* is an enlarged view of area B of FIG. 8*a*, and FIGS. 9*a* and 9*b* show the front and rear parts of the pencil in an operating condition where the tip is axially displaced at a maximum with respect to the shaft 10.

FIG. 7*a* shows an operating condition in which the cap 12 is unscrewed and the pencil is therefore in a condition of being ready to write. In particular the control pushrod 34 is coupled to the plunger 30, the spring 36 is stressed and a corresponding pressure obtains in the storage means 24. However, still no axial force acts on the tip 18, from the tip 18.

FIGS. 8*a* through 8*d* show an operating condition which differs from that shown in FIGS. 7*a* through 7*d* in that a slight axial force acts on the tip 18. As a result the tip 18 is displaced in the axial direction with respect to the external shaft 10. As the tip 18 is coupled in the axial direction to the casing portion 22, the casing portion 22 is also displaced in the axial direction with respect to the external shaft 10. Because of the coupling of the casing portion 22 by way of the screwthread elements 48, 50 to the control pushrod 34, the control pushrod 34 is also displaced, more specifically against the elastic return force of the spring 36. Accordingly an elastic return force is operative against axial displacement of the tip 18 with respect to the external shaft 10. The tip 18 is thus sprung.

Figure 9A:
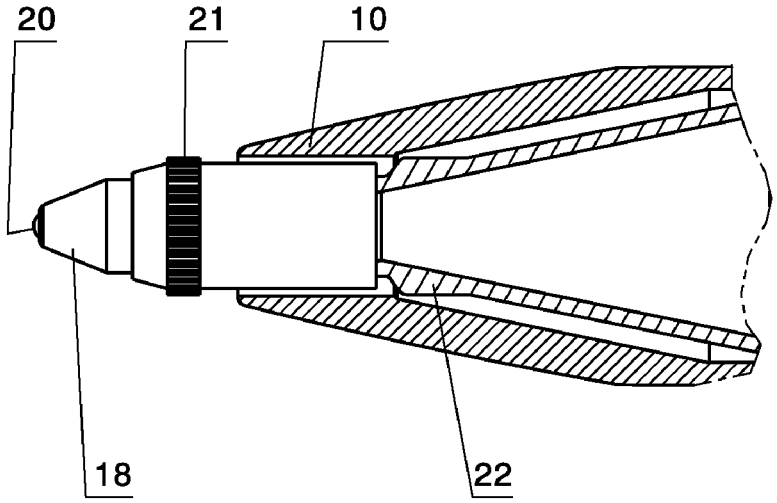
Figure 9B:
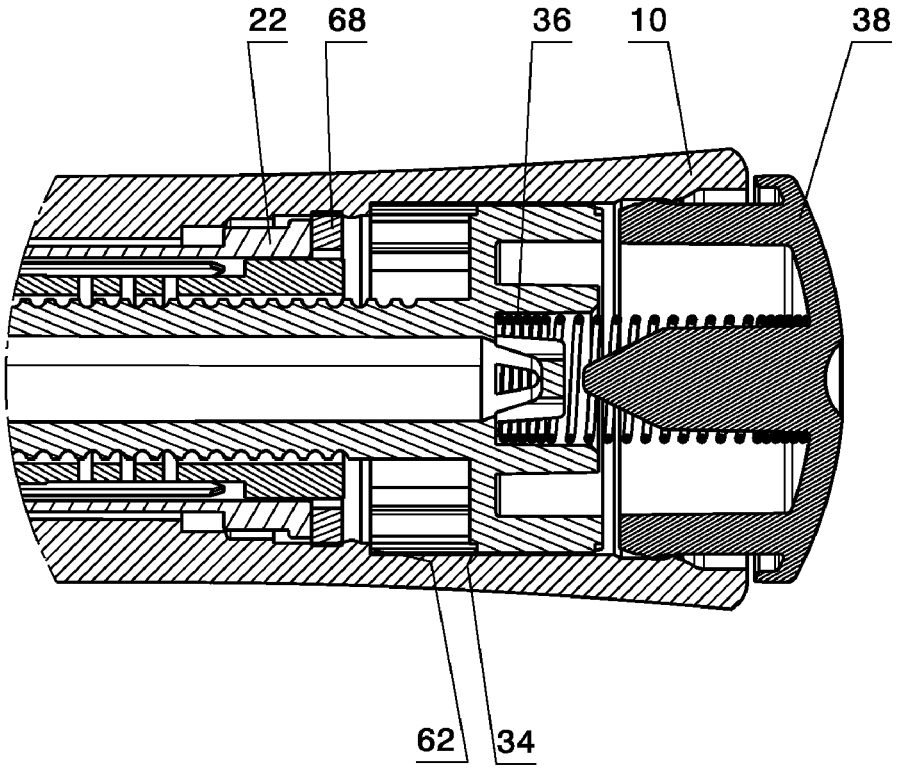

FIGS. 9*a* and 9*b* show that operating condition in which the tip 18 is axially displaced at a maximum with respect to the external shaft 10. That condition is reached when the casing portion 22 butts against an abutment 66. The abutment 66 is provided on an abutment ring 68 which is held axially immovably in the external shaft 10. The side of the abutment ring 68, which is in opposite relationship to the abutment 66, can serve as an abutment for the control pushrod 34, instead of the projection 62.

In the particularly preferred embodiment of the invention as illustrated in the drawing the polymer spring 36 serves two purposes at the same time, namely on the one hand producing increased pressure in the storage means 24 and on the other hand springing the tip 18 in the axial direction in regard to displacement with respect to the external shaft 10.

The features of the invention disclosed in the foregoing description, the claims and the drawing can be essential both individually and also in any combinations for implementing the invention in the various embodiments thereof.

The invention claimed is:

1. An applicator device comprising a casing (10), a storage means (24) for a product (26) to be applied and an application means (18), wherein the application means (18) is displaceable axially with respect to the casing (10) against a return force, wherein the return force comprises at least one elastic element (36) and the elastic element (36) is part of an increased pressure-producing device (22, 30, 34, 36) and is adapted to press with its elastic return force against a boundary means (30) of the storage means (34) to produce an increased pressure in the storage means (24).

2. An applicator device as set forth in claim 1 wherein the application means (18) is displaceable with respect to the casing (10) by between 0.05 mm and 10 mm.

3. An applicator device as set forth in claim 1 wherein the application means (18) is displaceable with respect to the casing (10) by between 0.05 mm and 2 mm.

4. An applicator device as set forth in claim 1 wherein the application means (18) is displaceable with respect to the casing (10) by between 0.2 mm and 0.5 mm.

5. An applicator device as set forth in claim 1, wherein the return force is between 0.03 N and 50 N.

6. An applicator device as set forth in claim 1, wherein the return force is between 0.03 N and 10 N.

7. An applicator device as set forth in claim 1, wherein the return force is between 0.03 N and 0.5 N.

8. An applicator device as set forth in claim 1, wherein the application means (18) has a ball (20) and the quotient of the return force and the equatorial cross-sectional area of the ball (20) is between 4 Pa and 6 GPa.

9. An applicator device as set forth in claim 1, wherein the application means (18) has a ball (20) and the quotient of the return force and the equatorial cross-sectional area of the ball (20) is between 40 Pa and 1 GPa.

10. An applicator device as set forth in claim 1, wherein the application means (18) has a ball (20) and the quotient of the return force and the equatorial cross-sectional area of the ball (20) is between 10 kPa and 7 MPa.

11. An applicator device as set forth in claim 1, wherein the elastic element (36) is a spring.

12. An applicator device as set forth in claim 1, wherein the elastic element (36) is a coil spring.

13. An applicator device as set forth in claim 1, wherein the elastic element (36) comprises a polymer material.

14. An applicator device as set forth in claim 1, wherein the increased pressure-producing device (22, 30, 34, 36) includes means to cause a reduction in the pressure in the storage means (24).

15. An applicator device as set forth in claim 1, wherein the increased pressure-producing means (22, 30, 34, 36) has a transmission means with at least one female screwthread element (48) and at least one male screwthread element (50), wherein the transmission means assume at least two operating conditions, comprising a first operating condition in which the two screwthread elements (48, 50) mesh with each other to produce the increased pressure, and a second operating condition in which they do not mesh with each other, thereby resulting in a reduction in the increased pressure.

16. An applicator device as set forth in claim 1, wherein the increased pressure-producing means has at least two operating conditions, namely a rest condition and a use condition, and has a means (19, 21, 22, 30, 34, 36) for reducing the pressure in the storage means (24), said pressure-reducing means being responsive to a movement of the applicator device from the use condition into the rest condition.

17. An applicator device as set forth in claim 16, wherein the increased pressure-producing means is movable from the use condition into the rest condition by screwing on a cap (12).

* * * * *

UNITED STATES PATENT AND TRADEMARK OFFICE

CERTIFICATE OF CORRECTION

PATENT NO. : 7,641,411 B2
APPLICATION NO. : 11/179403
DATED : January 5, 2010
INVENTOR(S) : Friedrich Biegel It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 620 days.

Signed and Sealed this

Twenty-first Day of December, 2010

David J. Kappos

David J. Kappos
*Director of the United States Patent and Trademark Office*